United States Patent [19]

Eisenberg

[11] Patent Number: 4,575,975

[45] Date of Patent: Mar. 18, 1986

[54] PORTABLE PLATFORM TRESTLE FOR STAGES, PLATFORMS, PEDESTALS OR THE LIKE

[76] Inventor: Hans J. Eisenberg, Iriebelsheide 59, 5600 Wuppertal 1, Fed. Rep. of Germany

[21] Appl. No.: 719,510

[22] Filed: Apr. 3, 1985

[30] Foreign Application Priority Data

Apr. 4, 1984 [DE] Fed. Rep. of Germany ..... 3412549

[51] Int. Cl.[4] ..... E04H 12/18

[52] U.S. Cl. ..... 52/109; 52/646; 108/132; 182/152

[58] Field of Search ..... 52/109, 645, 646; 108/131, 132, 133, 136; 182/152, 153

[56] References Cited

U.S. PATENT DOCUMENTS

| | | | |
|---|---|---|---|
| 460,583 | 10/1891 | Kautz | 182/153 |
| 583,034 | 5/1897 | Davis | 52/109 |
| 3,700,070 | 10/1972 | King | 52/109 |

FOREIGN PATENT DOCUMENTS

| | | | |
|---|---|---|---|
| 2041973 | 3/1972 | Fed. Rep. of Germany | 182/152 |
| 424130 | 5/1967 | Switzerland | 108/133 |

*Primary Examiner*—John E. Murtagh
*Assistant Examiner*—C. Dennison
*Attorney, Agent, or Firm*—Antonelli, Terry & Wands

[57] ABSTRACT

A platform trestle adapted for assembly or disassembly with similar platform trestles to form stages for public events is provided with an upper platform, an upper and a lower frame, and four scissor members, the platform trestle being manually adjustable as to height. All of the scissors are arranged side by side and respectively two of the scissors by pairs of respectively an outer and an inner scissor member at the longitudinal sides of the platform. Moreover the legs and the arms of the outer and of the inner scissors are strutted by cross bracings so that the platform trestle is very stable, but still portable by two persons and is adjustable at a maximum height just under the length of its platform.

16 Claims, 11 Drawing Figures

Fig. 5
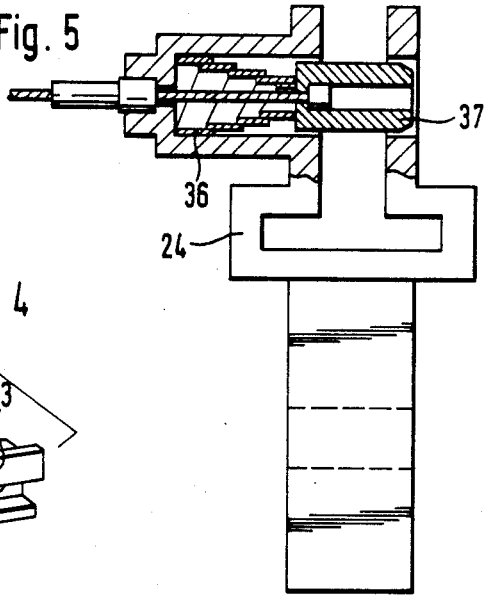
Fig. 4
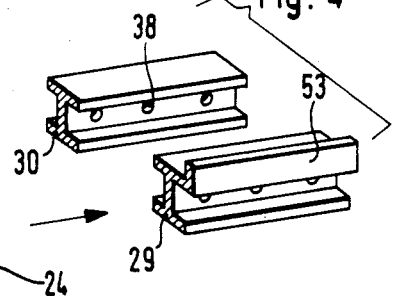
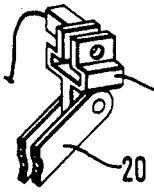
Fig. 3
Fig. 6
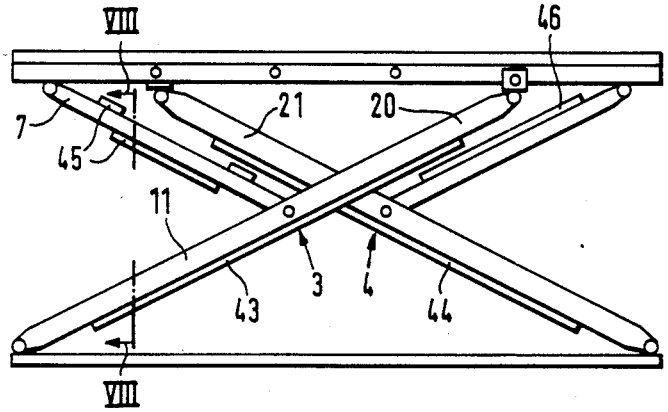

PORTABLE PLATFORM TRESTLE FOR STAGES, PLATFORMS, PEDESTALS OR THE LIKE

CROSS REFERENCE TO RELATED APPLICATIONS

Applicant makes reference to his West German Patent Application No. P 34 12 549.3 filed Apr. 4, 1984 under which priority is claimed under the provisions of 35 USC 119.

BACKGROUND OF THE INVENTION

1. FIELD OF THE INVENTION

The invention relates to a portable platform trestle for assembly with similar platform trestles to form stages for public events, the platform trestle being manually adjustable as to height, adapted to be fold up into a flat package stackable with similar folded platform trestle to compact storage piles, and provided with a platform, a retangular upper frame, a lower frame and respectively two scissors on two opposite longitudinal sides, whereby the legs and the arms of the scissors are articulated with one end within the reach of corresponding corners of the upper and the lower frames and whereby the other end of said legs can be moved along lateral guideways of the trestle and arrested thereon for adjusting the height of the trestle.

2. DESCRIPTION OF THE PRIOR ART

Such platform trestles as are supported by way of scissors for the variable formation of stages, pedestals and platforms have been known in the prior art, for example, from the U.S. Pat. No. 4,047,594. Such known platform trestles are disposed directly side by side and are adjustable always to the desired level, whereby they are mutually interlocked. In practice, the known platform trestles proved very useful especially because of their high loading capacity and their little need of stowage capacity.

Nevertheless, the maximum height of the known platform trestles is limited to just under the half of their length so that for a usual length of eight feet the maximum height is of about three and a half feet. If the legs of the scissors were longer than the half of the length of the platform trestle, they would block each other and thus prevent the folding-up of the platform trestle. Moreover, with longer legs, the known platform trestle would not be rigid enough to support a charge of several tons, especially when affecting a corner of the trestle. After all, a stiffening of longer legs by enlarging their diameter would not be possible, because in that case the platform trestle would become too heavy so that it would not be carried and adjusted by two persons.

Furthermore, there have been known lifting stages from the U.S. Pat. No. 2,874,805 and the German Utility Model No. 18 39 223, the stages comprising respectively an upper platform and four scissor members, the legs of which are quite of the same length as the length of the platform. These known lifting stages are meant for lifting cars of similar, very heavy objects so that they have to be operated by motors or hydraulic means. The legs of their scissors are of quite a great diameter and thus very heavy so that they are completely stationary. A transport by two persons would be absolutely impossible.

OBJECT OF THE INVENTION

A first object of the invention is to provide a variable platform trestle the maximum height of which is nearly as great as the length of its platform and which still can be completely folded up into a flat package, which can be manually adjusted as to height, which is portable by two persons and which is very stable, even if charged at its corners. For a lot of public events, it is prescribed that the height of the stages is of about six feet, e.g. in the case of rock concerts. Therefore a special object of the invention is to provide a stable, portable platform trestle with a platform length of about eight feet and a maximum height of about six feet.

SUMMARY OF THE INVENTION

According to the invention, the solution of this task is achieved by arranging all of the scissors side by side and respectively two of the scissors by pairs of respectively outer and inner scissors at the longitudinal sides of the platform trestle, the two outer scissors and the two inner scissors being articulated at opposite front sides of the platform trestle and by providing a first cross bracing means between the legs of the two inner scissors and a second cross bracing means between the legs of the two outer scissors, wherein the second cross bracing means defines a passage for receiving the inner scissors folded between the legs of the outer scissors.

According to further advantageous features of the invention a third cross bracing means is arranged between the arms of the inner scissors and a fourth cross bracing means is arranged between the arms of the outer scissors, the fourth cross bracing means defining a passage for receiving the legs and the first cross bracing members of the two inner scissors folded between the legs of the outer scissors.

BRIEF DESCRIPTION OF THE DRAWING

The invention will be explained in more detail in the following pages on the basis of three embodiments shown in the drawing.

FIG. 3 shows—in a perspective view—a slide at which a movable scissor leg is articulated, FIG. 4 shows two girders for slides according to FIG. 3 in a perspective view, FIG. 5 shows the slide of FIG. 3 in a sectional view, FIG. 6 shows the platform trestle in a lateral view taken in a direction of arrow VI in FIG. 1.

The FIGS. 1 and 2 illustrate a manually adjustable platform trestle all-round directly applicable to similar platform trestles to form a theater stage or the like. The trestle comprises a rectangular upper frame 1 carrying a platform 2—only shown in a broken line for reasons of clearness of the drawing—and of four Y-scissors 3, 4, 5, 6 arranged by pairs at two opposite lateral sides of the upper frame 1 and respectively articulated by their shorter arms 7, 8, 9, 10 within the reach of a corner of the upper frame 1. The lower arms 11, 12, 13, 14 of the longer Y-legs 49, 50, 51, 52 are respectively articulated at bottom supports generally designated by the reference members 15, 16, 17, 18 which—in the embodiment of FIG. 1—are fastened in the reach of the corners of a rectangular lower frame 19 with the same dimensions of the horizontal projection as the upper frame 1; cf. FIG. 2. As the scissors 3, 4, 5, 6 are articulated at or very near the corners as well of the upper frame 1 as of the lower frame 19, the platform trestle is very stable and can support high charges even at its corners. The upper frame 1, the lower frame 19 and the scissors 3, 4, 5, 6 are all made up of sectional girders of aluminum which are quite stiff, but very light.

Figure 1:
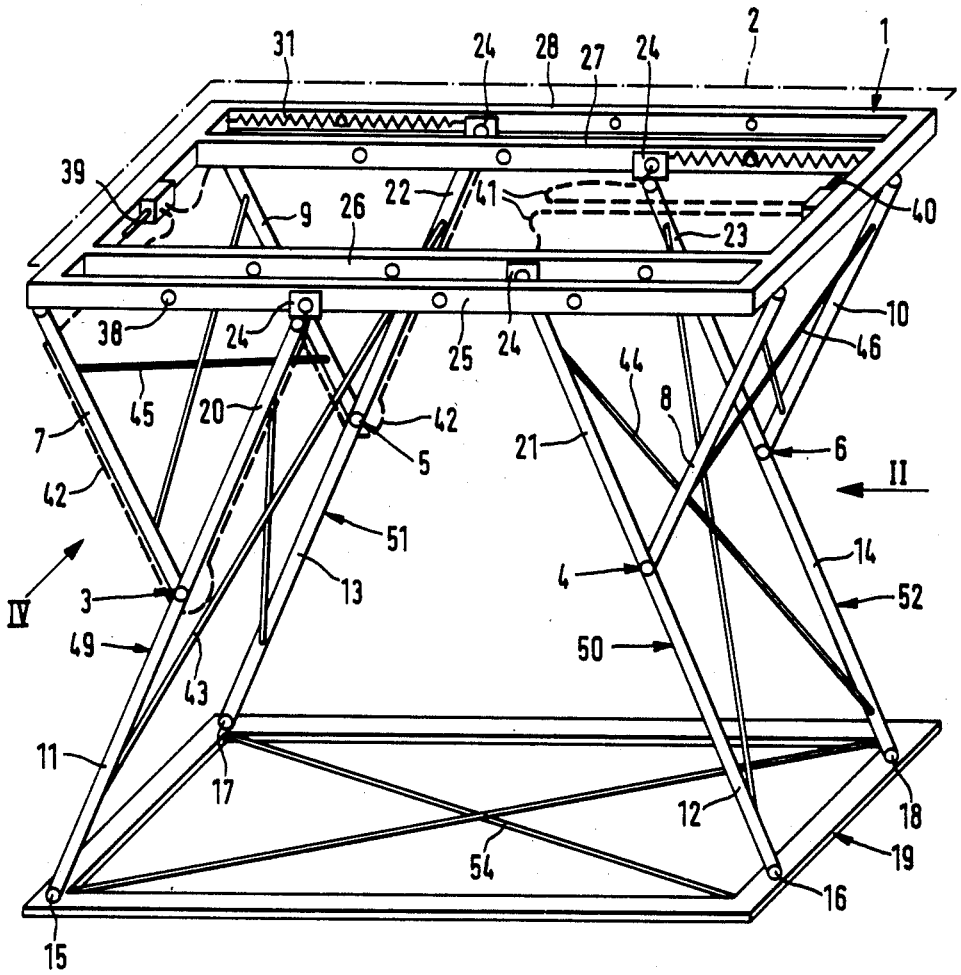
FIG. 1 shows a platform trestle adjusted in its second highest position in a schematic way.

The upper arms 20, 21, 22, 23 of the longer Y-legs 49, 50, 51, 52 are respectively articulated to slides 24. At the upper frame 1, there are provided four parallel guideways—generally designated by the references 25, 26, 27, 28—arranged closely together by pairs, a slide 24 respectively running on each of the guideways 25, 26, 27, 28. All of the scissor-arms 7 to 14 and 20 to 23 are nearly of half the length of the platform trestle. Each of the slides 24 is linked to a tension spring 31 which draws the slide 24 in the direction of the articulation of the respective shorter arm 7, 8, 9, 10, thus assisting the manual lifting of the platform.

Figure 2:
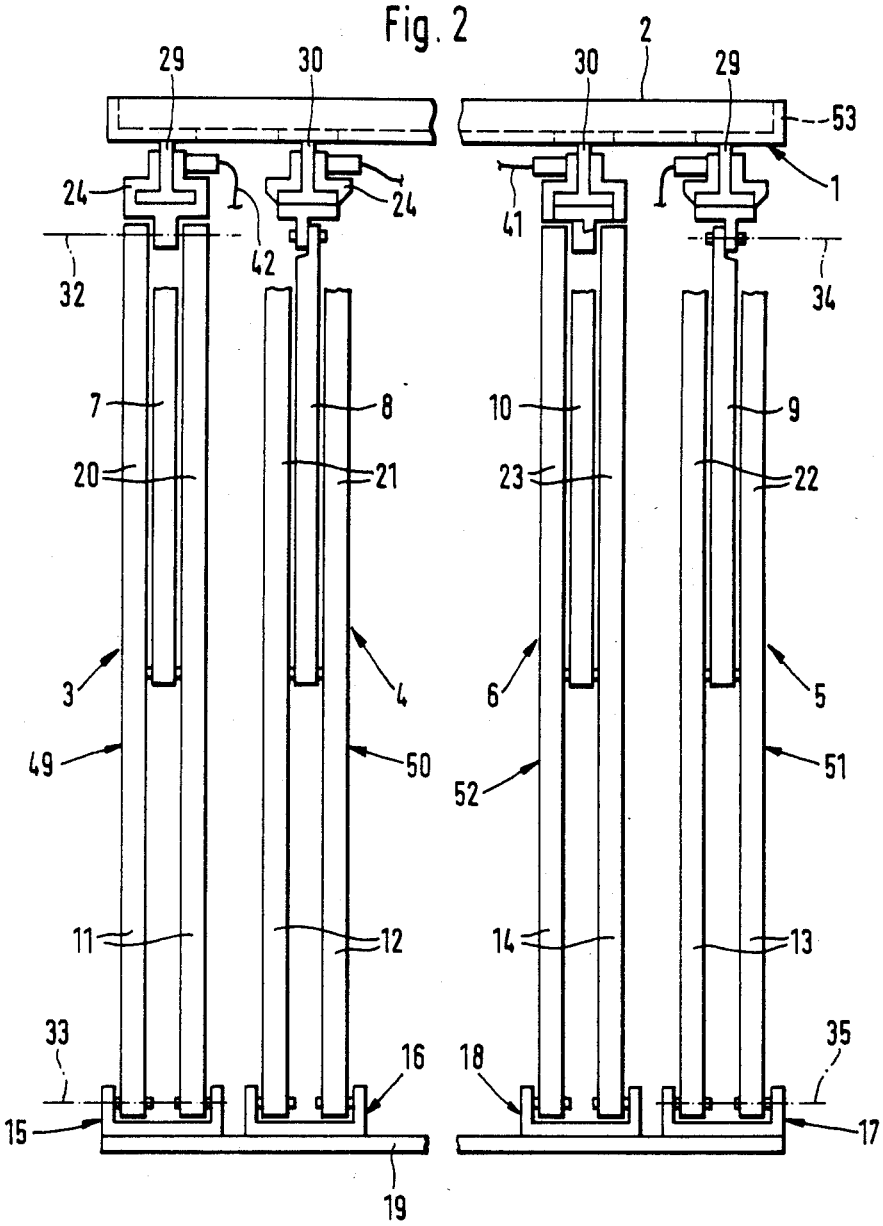
FIG. 2 is a front view of the platform trestle taken in the direction of arrow II in FIG. 1.

As clearly shown in FIG. 2 the outer scissors 3 and 5 are respectively guided by a girder 29 with a T or I section forming the outer guideways 25, 28 and thus being parts of the upper frame 1. The outer girders 29 are additionally provided with sectional bars 53 for putting in the upper platform 2. The inner scissors 4, 6 and their respective guiding girders 30 are arranged by the side of the outer scissors 3, 5 at a distance of half a hand's breadth so that the outer scissors 3, 5 with their arms 7, 11, 20 and 9, 13, 22 and with all their articulations 32, 33 and 34, 35 are located on the outside of the space defined by the inner scissors 4, 6.

As the FIGS. 3 and 5 show on a larger scale, every slide 24 has a spring-loaded engaging bolt 37—especially loaded by a conical, spiral pressure spring 36—the bolt 37 being engaged, according to the desired position of the platform 2, to one of several permanent engaging apertures 38 of the guiding girders 29, 30. The engaging bolts 37 can be pulled out by means of Bowden cables 41, 42 actuated by hand levers 39, 40 respectively placed at a front side of the trestle.

The Bowden cables 41 connecting the hand lever 40 and the slides 24 of the inner scissors 4, 6 are arranged below the platform 2. On the contrary the Bowden cables 42 run from the hand lever 39 to the respective lateral corners of the upper frame 1 and then along the arms 7, 20 respectively 9, 22 of the outer scissors 3, 5 and end in the narrow interstice between the parallel guiding girders 29, 30, thus pulling out the engaging bolts 37 in the direction of this interstice. Furthermore, the Bowden cables 42 cannot be cut by the inner scissors 4, 6 when folding up the platform trestle.

In order to render possible quite a short distance between the guiding girders 29, 30, the slides 24—including the bearings of the engaging bolts 37—are built up in a very compact manner as shown in the sectional view of FIG. 5. On principle it would be possible to arrange the Bowden cables 42 of the outer scissors 3, 5 in a way that the engaging bolts 37 can be pulled outwards.

In order to further increase its inner stiffness and its stability, the platform trestle is provided with diagonal struts between the corresponding arms of the two inner scissors 4, 6 and the corresponding arms of the two outer scissors 3, 5. For reasons of clearness of the drawings said struts are shown in FIG. 1 only in a schematic way and completely omitted in FIG. 2.

Figure 7:
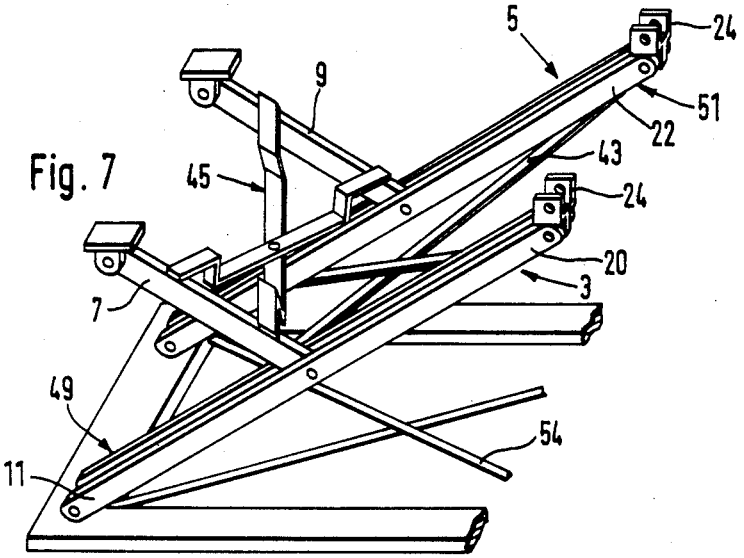
FIG. 7 is a partial view of the platform trestle for illustrating the cross bracing members of the outer scissors.
Figure 8:
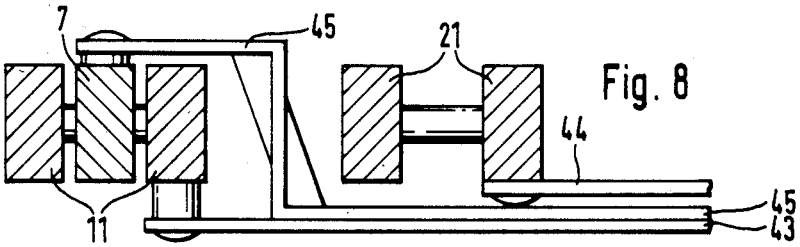
FIG. 8 is a sectional view of outer and inner scissors in the reach of the cross bracing of the arms of the outer scissors following the lines VIII—VIII in FIG. 7, but with the platform trestle completely folded up.

The long legs 49, 51 built up of the arms 11, 20 respectively 13, 22 are strutted by a great diagonal cross bracing 43 applied to the long legs 49, 51 at the opposite side of the short, swing-out arms 7, 9. In the same way the two long legs 50, 52 of the inner scissors 4, 6 are strutted by a great diagonal cross bracing 44. Furthermore a diagonal cross bracing 45, 46 is respectively provided between the short legs or arms 7, 9 of the two outer scissors 3, 5 and between the arms 8, 10 of the two inner scissors 4, 6, the bracings 45, 46 being applied to the short arms 7/9, 8/10 at the opposite side of the respective long legs so that the short arms 7, 9, 8, 10 can be completely swung between two bars respectively forming a long leg 49, 51, 50, 52 in order to fold up the platform trestle in a completely flat way; cf. FIG. 7. The cross bracing 45 arranged between the arms 7, 9 of the outer scissors 3, 5 is bended at angles into a hat-like form, so that it can receive the inner scissors 4, 6, when the trestle is folded up.

For a further stiffening of the platform trestle, the lower frame 19 is strutted by a diagonal cross bracing 54, too.

Figure 9:
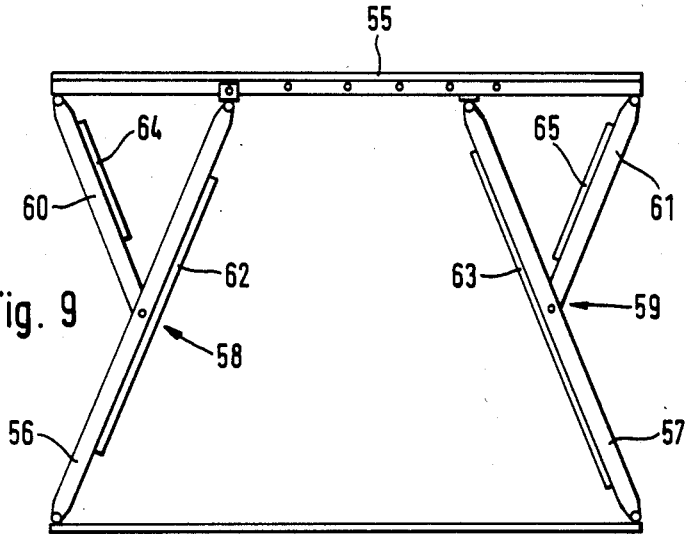
FIG. 9 shows a second embodiment of a platform trestle in a high adjustment position.
Figure 10:
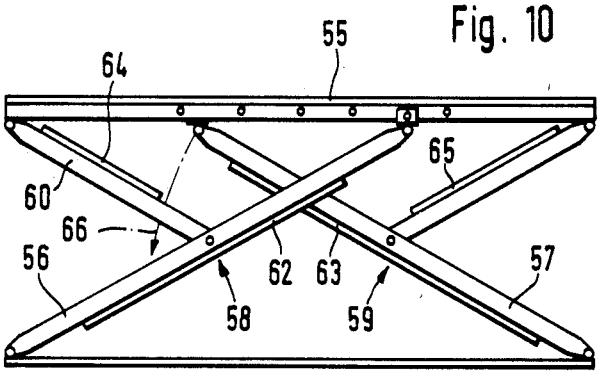
FIG. 10 shows the platform trestle of FIG. 9 in a low adjustment position.
Figure 11:
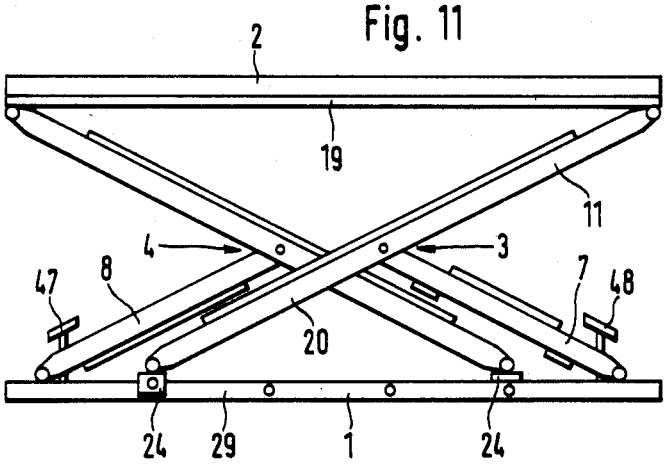
FIG. 11 shows a third embodiment of a platform trestle.

The FIGS. 9 and 10 show, according to scale, a second embodiment of a platform trestle with a length of the platform 55 of eight feet. The long legs 56, 57 of the scissors 58, 59 are a little bit longer than six feet, whereby a maximum adjustment height of six feet can be easily achieved as illustrated in FIG. 9. With this relation of dimensions the long legs 56, 57 and the short arms 60, 61 are clearly inclined even in the highest position of the platform 55 so that the platform trestle is always very stable. For a further stiffening, the legs 56, 57 and the arms 60, 61 are strutted—similar to the embodiment of FIG. 6—by cross bracing 62, 63, 64, 65. But, as the long legs 56, 57 are shorter than the platform 55, it is not necessary to bend the cross bracing 64 of the arms 60 of the outer scissors 58 at angles into a hat-like form. As illustrated by the arrow 66 in FIG. 10, the cross bracing 64 defines a free passage for the inner scissors 59, if it is not completely reaching to the lower ends of the arms 60, thus allowing the folding-up of the platform trestle. FIG. 11 shows a further embodiment of a platform trestle the scaffold of which is consisting of the two frames 19, 1 and the four Y-scissors 3, 4, 5, 6 like the embodiment of FIG. 1, but is turned upside down so that the guiding girders 29, 30 and the respective slides 24 are placed near the floor and must not be lifted when the platform 2 is raised. The engaging bolts can be manipulated by Bowden cables or the like, too, and for actuating the Bowden cables the inferior frame 1 can be provided with foot levers 47, 48. Alternatively, the superior frame 19 can be provided with a similar, manually operated mechanism like the levers 39, 40.

What I claim is:

1. A portable platform trestle for assembly with similar platform trestles to form stages for public events, the platform trestle being manually adjustable as to height and adapted to be folded up into a flat package stackable with similar folded platform trestles to compact storage piles, comprising a platform, carried by a rectangular upper frame means, a lower frame means, four scissors, each made up of a long leg and further of an arm articulated with one end at the middle part of the leg, each scissors being articulated within the reach of corresponding trestle corners with the other end of said arm at the upper frame means and with the lower end of said leg at the lower frame means, the upper end of said leg being movable, wherein all of said four scissors are arranged side by side and respectively two of the scissors are arranged by pairs of respectively outer and inner scissors at the longitudinal sides of the platform trestle, the two outer scissors and the two inner scissors being articulated at opposite front sides of the platform trestle, four parallel scissor guideways, provided at the upper frame, four slide means, each running along one of said guideways and being connected with the upper movable end of the leg of the respective scissors, arresting means for arresting the slide means at the guideways and thereby adjusting the height of the platform, operating means arranged at the front sides of the platform trestle for actuating the arresting means during the manual height adjustment of the platform, flexible force transmission means connecting the operating means and the arresting means, the transmission means for the arresting means of the two outer scissors being installed along the arm and the upper part of the leg of the respective scissors, a first cross bracing means between the legs of the two inner scissors, and a second cross bracing means between the legs of the two outer scissors, wherein the second cross bracing means defines a passage for receiving the inner scissors, folded between the legs of the outer scissors.

2. A portable platform trestle as claimed in claim 1 wherein a third cross bracing means is arranged between the arms of the inner scissors and a fourth cross bracing means is arranged between the arms of the outer scissors, the fourth cross bracing means defining a passage for receiving the legs and the first cross bracing means of the two inner scissors folded between the legs of the outer scissors.

3. A portable platform trestle as claimed in claim 2, wherein each long leg of the scissors consists of two parallel bars, between which the arm of the corresponding scissors is arranged in a manner to be completely swung in between said bars.

4. A portable platform trestle as claimed in claim 3, wherein the fourth cross bracing means consists of two struts, which are fixed at their ends to the upper side of the arms of the outer scissors and which are bended at angles downwardly into a hat-like form thus defining said passage.

5. A portable platform trestle as claimed in claim 2, wherein the second cross bracing means is fixed at the lower side of the legs of the outer scissors and the third cross bracing means is fixed to the upper side of the arms of the inner scissors.

6. A portable platform trestle as claimed in claim 1, wherein tension springs are linked between the movable upper end of the leg and the upper end of the arm of each scissors, thus assisting the manual lifting of the platform.

7. A portable platform trestle as claimed in claim 1, wherein the lower frame means are stiffened by a diagonal cross bracing means.

8. A portable platform trestle as claimed in claim 1, wherein the lateral distance between the two neighboring scissors at each longitudinal side of the trestle is of about half an hand's breadth.

9. A portable platform trestle as claimed in claim 1, wherein the length and the breadth of the platform are of about eight feet respectively four feet and wherein the maximum height of platform adjustment is about six to seven feet.

10. A portable platform trestle as claimed in claim 1, wherein the length of the legs of the scissors is of about 75 to 90 per cent of the length of the platform trestle.

11. A portable platform trestle as claimed in claim 1, wherein the flexible force transmission means are Bowden cables.

12. A portable platform trestle as claimed in claim 11, wherein the guideways are provided with several apertures and the arresting means are spring-loaded bolts engaging into one of the several apertures of the guideways and wherein the bolts are retractable by the Bowden cables.

13. A portable platform trestle for assembly with similar platform trestles to form stages for public events, the platform trestle being manually adjustable as to height and adapted to be folded up into a flat package stackable with similar folded platform trestles to compact storage piles, comprising a platform, carried by a rectangular upper frame means, a lower frame means, four scissors, each made up of a long leg and further of an arm articulated with one end at the middle part of the leg, each scissors being articulated within the reach of corresponding trestle corners with the other end of said arm at the upper frame means and with the lower end of said leg at the lower frame means, the upper end of said leg being movable, wherein all of said four scissors are arranged side by side and respectively two of the scissors are arranged by pairs of respectively outer and inner scissors at the longitudinal sides of the platform trestle, the two outer scissors and the two inner scissors being articulated at opposite front sides of the platform trestle, four parallel scissor guideways, provided at the upper frame, four slide means, each running along one of said guideways and being connected with the upper movable end of the leg of the respective scissors, arresting means for arresting the slide means at the guideways and thereby adjusting the height of the platform, a first cross bracing means between the legs of the two inner scissors, a second cross bracing means between the legs of the two outer scissors, wherein the second cross bracing means defines an upper passage for receiving the inner scissors folded between the legs of the outer scissors, a third cross bracing means, arranged between the arms of the inner scissors, and a fourth cross bracing means arranged between the arms of the outer scissors, the fourth cross bracing means defining a passage for receiving the legs and the first cross bracing means of the two inner scissors folded between the legs of the outer scissors.

14. A portable platform trestle for assembly with similar platform trestles to form stages for public events, the platform trestle being manually adjustable as to height and adapted to be folded up into a flat package stackable with similar folded platform trestles to compact storage piles, comprising a platform, carried by a rectangular upper frame means, a lower frame means, four scissors, each made up of a long leg and further of an arm articulated with one end at the middle part of the leg, each scissors being articulated within the reach of corresponding trestle corners with the other end of said arm at the upper frame means and with the lower end of said leg at the lower frame means, the upper end of said leg being movable, wherein all of said four scissors are arranged side by side and respectively two of the scissors are arranged by pairs of respectively outer and inner scissors at the longitudinal sides of the platform trestle, the two outer scissors and the two inner scissors being articulated at opposite front sides of the platform trestle, four parallel scissor guideways, provided at the upper frame, four slide means, each running along one of said guideways and being connected with the upper movable end of the leg of the respective scissors, arresting means for arresting the slide means at the guideways and thereby adjusting the height of the platform, operating means arranged at the front sides of the platform trestle for actuating the arresting means during the manual height adjustment of the platform, a first cross bracing means between the legs of the two inner scissors, and a second cross bracing means between the legs of the two outer scissors, wherein the second cross bracing means defines an upper passage for receiving the inner scissors, folded between the legs of the outer scissors, wherein the length and the breadth of the platform are of about eight feet respectively four feet and that the maximum height of platform adjustment is about six to seven feet.

15. A portable platform trestle for assembly with similar platform trestles to form stages for public events, the platform trestle being manually adjustable as to height and adapted to be folded up into a flat package stackable with similar folded platform trestles to compact storage piles, comprising a platform, carried by a rectangular upper frame means, a lower frame means, four scissors, each made up of a long leg and further of an arm articulated with one end at the middle part of the leg, each scissors being articulated within the reach of corresponding trestle corners with the other end of said arm at the lower frame means and with the upper end of said leg at the upper frame means, the lower end of said leg being movable, wherein all of said four scissors are arranged side by side and respectively two of the scissors are arranged by pairs of respectively outer and inner scissors at the longitudinal sides of the platform trestle, the two outer scissors and the two inner scissors being articulated at opposite front sides of the platform trestle, four parallel scissor guideways, provided at the lower frame, four slide means, each running along one of said guideways and being connected with the lower movable end of the leg of the respective scissors, arresting means for arresting the slide means at the guideways and thereby adjusting the height of the platform, operating means arranged at the front sides of the platform trestle for actuating the arresting means during the manual height adjustment of the platform, flexible force transmission means connecting the operating means and the arresting means, the transmission means for the arresting means of the two outer scissors being installed along the arm and the lower part of the leg of the respective scissors, a first cross bracing means between the legs of the two inner scissors, a second cross bracing means between the legs of the two outer scissors, wherein the second cross bracing means defines a lower passage for receiving the inner scissors, folded between the legs of the outer scissors.

16. A portable platform trestle for assembly with similar platform trestles to form stages for public events, the platform trestle being manually adjustable as to height and adapted to be folded up into a flat package stackable with similar folded platform trestles to compact storage piles, comprising a platform, carried by a rectangular upper frame means, a lower frame means, four scissors, each made up of a long leg and further of an arm articulated with one end at the middle part of the leg, each scissors being articulated within the reach of corresponding trestle corners with the other end of said arm at the upper frame means and with the lower end of said leg at the lower frame means, the upper end of said leg being movable, wherein all of said four scissors are arranged side by side and respectively two of the scissors are arranged by pairs of respectively outer and inner scissors at the longitudinal sides of the platform trestle, the two outer scissors and the two inner scissors being articulated at opposite front sides of the platform trestle, four parallel scissor guideways, provided at the upper frame, four slide means, each running along one of said guideways and being connected with the upper movable end of the leg of the respective scissors, arresting means for arresting the slide means at the guideways and thereby adjusting the height of the platform, operating means arranged at the front sides of the platform trestle for actuating the arresting means during the manual height adjustment of the platform, and flexible force transmission means connecting the operating means and the arresting means, the transmission means for the arresting means of the two outer scissors being installed along the arm and the upper part of the leg of the respective scissors.

* * * * *